US006499767B1

(12) United States Patent
Takemura

(10) Patent No.: US 6,499,767 B1
(45) Date of Patent: Dec. 31, 2002

(54) PRESENTATION DEVICE WITH AUTOMATIC EXTENDING SUPPORT

(75) Inventor: Shun Takemura, Pacific Palisades, CA (US)

(73) Assignee: Itoya of America, Ltd., Torrance, CA (US)

( * ) Notice: Subject to any disclaimer, the term of this patent is extended or adjusted under 35 U.S.C. 154(b) by 0 days.

(21) Appl. No.: 10/046,020

(22) Filed: Jan. 11, 2002

(51) Int. Cl.[7] ..... B42D 3/00

(52) U.S. Cl. ..... 281/33; 281/37; 248/441.1

(58) Field of Search ..... 281/15.1, 21.1, 281/28, 29, 36, 37, 33, 43, 44, 45, 51; 402/4, 70, 73, 80 R; 248/441.1, 447, 451, 460, 461

(56) References Cited

U.S. PATENT DOCUMENTS 4,296,946 A * 10/1981 Larre et al. ..... 281/33
4,315,642 A * 2/1982 Errichiello ..... 281/33
4,377,271 A * 3/1983 Smith ..... 281/33
5,988,686 A * 11/1999 Texido ..... 281/33

* cited by examiner

*Primary Examiner*—Willmon Fridie, Jr.
(74) *Attorney, Agent, or Firm*—Squire, Sanders & Dempsey, L.L.P.

(57) ABSTRACT

A display device such as a folder, binder or book includes transparent envelope pages and a support that deploys automatically when the covers of the display device are opened so that the display device can be supported on a horizontal surface by the lower edges of the covers and the deployed support. The deployment is caused by a tensioned elastic cord which also can be used to retain the covers in a closed position.

20 Claims, 3 Drawing Sheets

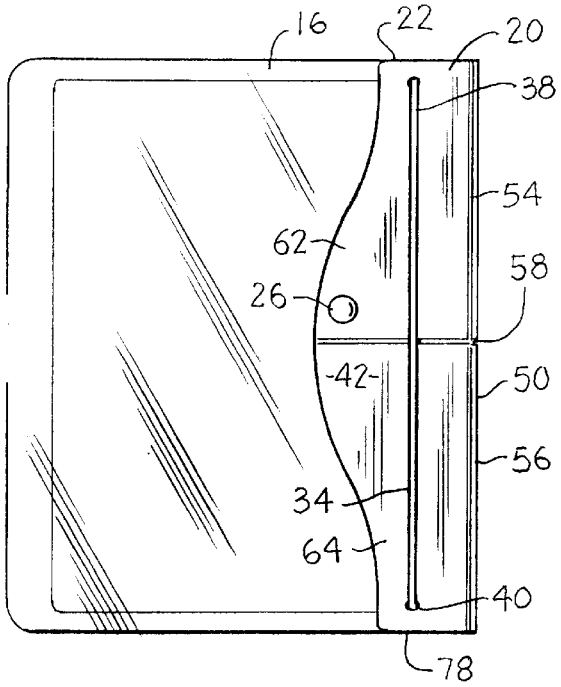
FIG. 4
FIG. 9
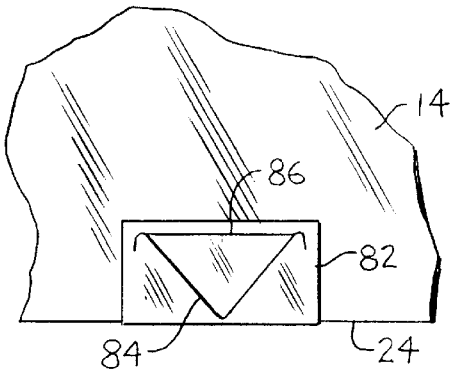
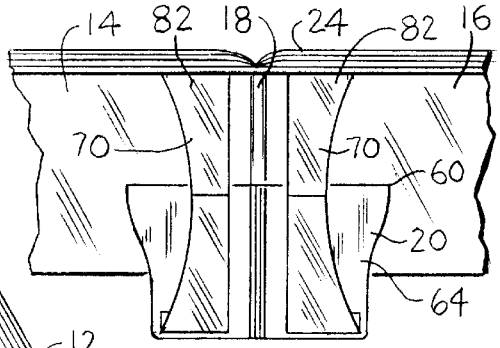
FIG. 7
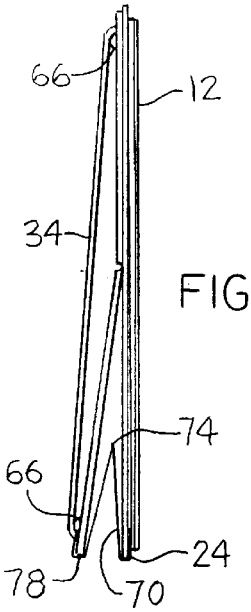
FIG. 5
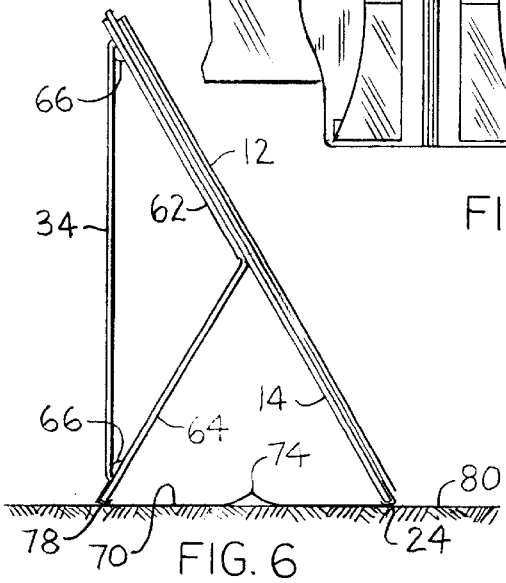
FIG. 6

PRESENTATION DEVICE WITH AUTOMATIC EXTENDING SUPPORT

BACKGROUND OF THE INVENTION

Many different kinds of portfolios, display binders, books, and folders exist, which hereinafter will be referred to generally as folders. Some well known types include three ring binders, spiral-bound notebooks and clasped folders. These are used to retain individual sheets, usually of paper, so that they can viewed as if they were bound in a book. Sometimes clear envelopes are included to retain and protect flat items for later display or study. These retained items typically include warranties, magazine clippings, reports and graphs, certificates, legal documents, photographs and negatives, collectible stamps and any other flat items including pressed flowers or other organic samples, where clear, usually plastic, envelopes can provide safe storage and display. When relatively bulky items are to be stored and displayed, it is desirable to provide some sort of positive closure so that the display pages are protected by the relatively stiff outer binding.

When viewing what is stored within such a folder, it is troublesome to find which of the pages include what material. Therefore, some folders, especially of the three ring type include index pages, usually of a relatively stiff material that have a tab that sticks out which when inserted between pages can indicate what is in the next section of the folder.

It is desirable that means be provided with the folder or attachable to the folder so that the folder can be propped up near vertical on a horizontal surface allowing display of the materials there within to a group or causal passers by.

SUMMARY OF THE INVENTION

The present invention includes a display folder with plurality of transparent display envelopes. It is preferable that the envelopes include an edge portion connected to the cover of the folder, a bottom side usually completely closed or sealed, an open top which may have a protective flap and an outer side with a plurality of slits formed therein. The slits may be an odd or even number, but when the slits are greater than four in number, even numbers of slits are preferred as such minimize the number of different index card that need be furnished. These index cards are formed to fit snugly within the envelopes, but have at least one cutaway inner corner on the opposite side from their tab to make insertion of the index card into an envelope easy. The index cards include index tabs positioned on a side edge to slip through a slit to provide an index tab for the envelope. When three silts are used in the various envelopes, pluralities of two or three separately formed index cards are provided, usually in the back of the folder when it is sold where multiple index cards can be stored in the back envelope. When four slits are provided in each envelope, pluralities of two different index cards can be formed for insertion through the slits while when six slits are provided in each envelope, pluralities of three different index cards can be formed for insertion through the slits.

As part of the outer cover of the folder, a relatively stiff outer spine reinforcement is include having an elastic cord connected near its top and bottom so that the cord can be looped around the folder spaced from the spine to retain the folder in a closed position. The upper portion of reinforcement may be permanently attached at the spine and slidably retained to the opposite covers by double buttons and slots whereas the lower portion, beneath a fold is retained by flexible ribbons. When the covers are moved apart, the elastic cord forces the lower portion outwardly until further motion is restrained by the ribbons to form a support for the folder. Thus the support automatically deploys when the folder is opened.

Therefore, it is an object of the present invention to provide a light and economical indexed folder with an automatically deploying support for display of materials, which increases the utility of the folder, especially those equipped with transparent envelopes for the display of information on sheets that need to be indexed directly and held flat.

Another object is to provide a versatile display system for a folder or binder where the elastic cord for deploying the support also acts to retain the folder is a secure closed position.

These and other objects and advantages of the present invention will become apparent to those skilled in the art after considering the following detailed specification and drawings wherein:

BRIEF DESCRIPTION OF THE DRAWINGS

FIG. 4 is a rear elevational view of the folder of FIG. 1 with the elastic cord in position to deploy the support;

FIG. 5 is an edge view of the folder of FIG. 1 as the support is starting to deploy;

FIG. 6 is an edge view of the folder of FIG. 1 with the support fully deployed;

FIG. 7 is an underside view of the folder showing the restraints that restrict deployment;

FIG. 9 is an enlarged detail view of the releasable connection of a restraint used to restrict the deployment of the support.

DETAILED DESCRIPTION OF THE SHOWN EMBODIMENTS

Figure 1:
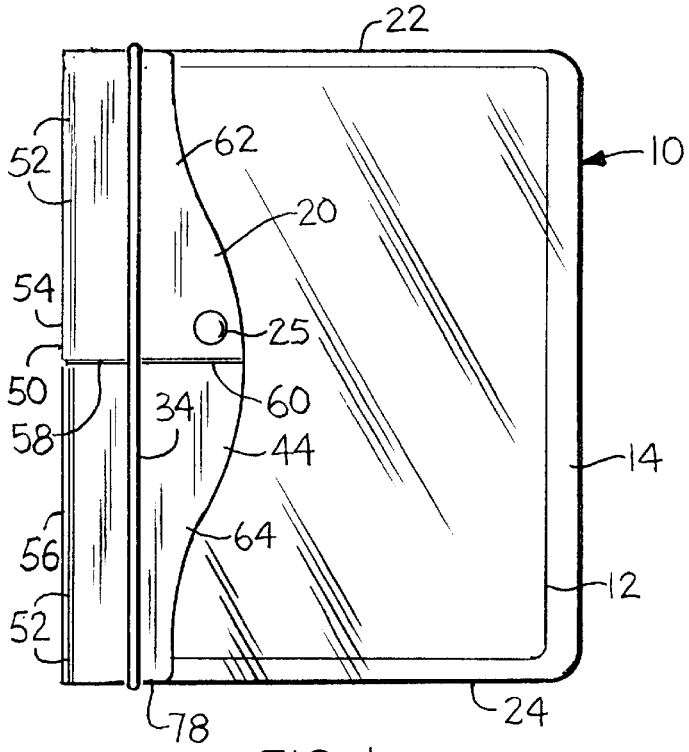
FIG. 1 is a front elevational view of a folder constructed in accordance with the present invention.

Referring to the Figures more particularly by reference numbers, number 10 in FIG. 1 refers to a folder constructed in accordance with the present invention including a plurality of transparent envelope pages 12. Although the folder 10 is shown as having transparent pages 12 permanently bound therein, in fact the folder 10 may be a looseleaf binder, a spiral bound notebook, a conventionally bound book or similar structure with front and rear covers 14 and 16 (see FIG. 2) that are relatively stiff.

Figure 3:
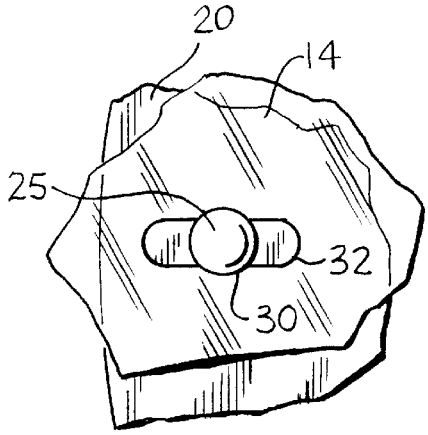
FIG. 3 an enlarged detail view showing how the support for the folder is retained to the covers of the folder.
Figure 2:
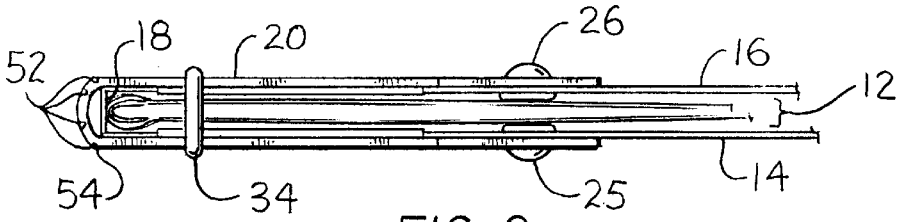
FIG. 2 is a top view of the folder of FIG. 1 showing how, when looped around both sides, an elastic cord holds the covers of the folder together.

The covers 14 and 16 are joined at a spine 18 so that they can be folded about the pages 12. The spine 18 and a portion of the adjacent covers 14 and 16 are enclosed by an outer support member 20 which extends from the top edge 22 to the bottom edge 24 of the covers 14 and 16. The support member 20 is attached to the covers by headed fasteners 25 and 26 which extend through holes 30 and 32 (FIG. 3) in each of the covers 14 and 16 and the support member 20 respectively. One of the holes 32 is an elongate slot to allow the support to fit adjacent the covers whether they are open or closed. The elongated slot 32 preferably is in a cover 14 or 16 so it is hidden from view for a neater appearance. As shown in FIGS. 1 and 2, the covers 14 and 16 and the support member 20 can be maintained in a closed condition by looping an elastic cord 34 from its attachments 38 and 40 on the back portion 42 of the support member 20 around the front portion 44 thereof (FIG. 4). Otherwise the cord 34 may just extend between the attachments 38 and 40 in an stressed condition as shown in FIG. 4. The attachments 38 and 40 may just be holes in the support member 20 with knots (not shown) tied on the ends of the cord 34 on the opposite sides.

The support member 20 includes a spine portion 50, usually stiffened by ribs 52, positioned adjacent the spine 18 of the folder 10. The spine portion 50 is split into upper and lower spine portions 54 and 56 by a fold relief slot 58 in alignment with a horizontally extending centrally located fold 60 in the support member 20 which divides the support member 20 into upper and lower portions 62 and 64. The upper support member portion 62 is retained to the covers 14 and 16 by the fasteners 25 and 26. In addition, when the support member 20 is not an add-on to an existing folder 10, the upper spine portion 54 may be permanently attached to the spine 18 of the folder 10, such as by heat or sonic welding. Therefore the upper portion 62 of the support member 20 is retained to the covers 14 and 16 and moves with them.

When the covers 14 and 16 are opened so they extend on a single plane, no matter whether the elastic cord 34 was previously biasing the covers 14 and 16 in closed parallel positions by being looped about the support member 20 or in the stressed position shown in FIG. 4, the elastic cord 34 moves to the position shown in FIG. 4. This causes the lower portion 64 to deploy outwardly as shown in FIGS. 5 and 6 by folding out about the horizontal fold 60. If very stiff material is used that causes the fold 60 to be resistant to initial bending, then optional ribs 66 can be formed adjacent the atachments 38 and 40 to provide leverage for an increased starting force to assure that the lower portion 64 deploys.

Figure 8:
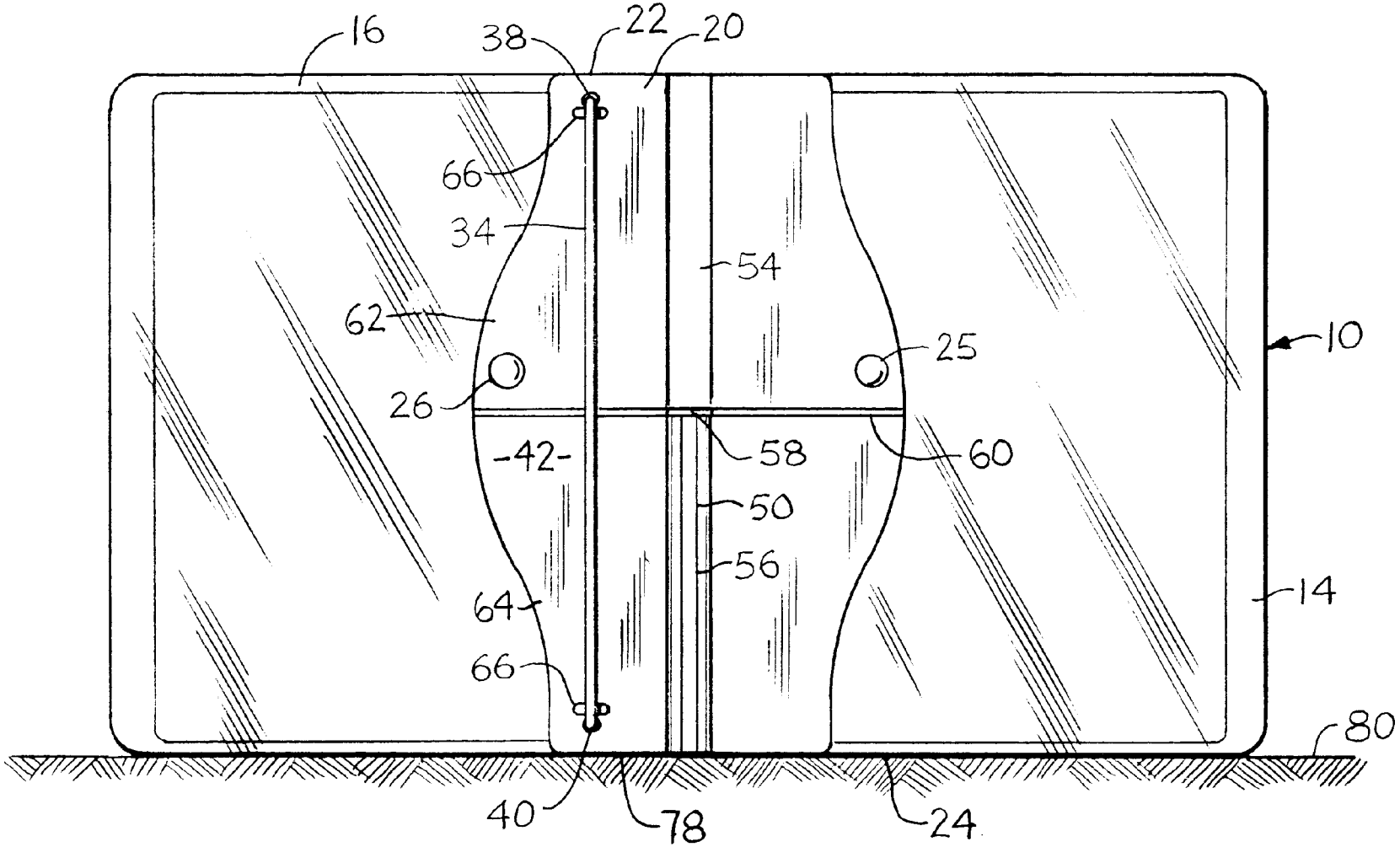
FIG. 8 is a elevational view of the folder with its support deployed resting on a horizontal surface.

One or more restraint ribbons 70 are connected between the lower portion 64 of the support member 20 and the bottom edge 24 of the covers 14 and 16. A memory crease 74 is centrally located in each restraint ribbon 70 so that they tend to fold up between the support member 20 and the adjacent cover 14 or 16 out of the way. The ribbons 70 can be seen in their normal placement in the underside view support deployed view of FIG. 7. When the lower portion 64 of the support member 20 is fully deployed and restrained against further deployment by the ribbons 70, the folder 10 can be placed the stable position shown in FIGS. 6 and 8 on a horizontal surface 80 with the bottom edges 24 of the covers 14 and 16 and the bottom edge 78 of the support member 20 in contact therewith, to display the pages 12 therein.

When the support member 20 is removable, the ribbons 70, instead of being merely glued or welded to the covers 14 and 16, can be releasably attached to the covers 14 and 16 as shown in FIG. 9 wherein the end 82 of a ribbon 70 has a triangle shaped tab 84 cut therein. The end 82 is wrapped under the bottom edge 24 and positioned in a slot 86 cut in the cover 14 or 16.

Thus, there has been shown and described presentation display folders which fulfill all of the objects and advantages sought therefore. Many changes, alterations, modifications, and other uses and applications of the subject invention, become apparent to those skilled in the art after considering the specification together with the accompanying drawings. All such changes, alterations, and modifications which do not depart from the spirit and scope of invention are deemed to be covered by the invention, which is limited only by the claims that follow.

What is claimed is:

1. A display device comprising:

a protector for holding generally planar displays having:
- a generally planar front cover;
- a generally planar rear cover; and
- a spine for connecting said front and rear covers together, whereby said front cover and said rear cover can be placed generally in spaced parallel and facing relationship, a planar relationship or any position therebetween, said generally planar front and rear covers each including:
  - an outer surface;
  - an upper edge; and
  - a lower edge; and a support sheet of material stiff enough to be self supporting, said support sheet including:

an upper portion having:
- a spine portion connected to said spine; and
- means to loosely connect said upper portion to said generally planar front cover and to said generally planar rear cover;

a lower portion having:
- a lower edge;
- a horizontal fold extending generally parallel to said lower edge between said upper and lower portions;
- a biasing member connected to act between said upper and lower portions normally adjacent one of said covers; and
- at least one flexible restraint connection between said lower portion and said covers, whereby said biasing member can be extended around a portion of its adjacent cover and the other cover to maintain the covers closed and when said front and rear covers are placed generally in a planar relationship cause said lower portion to fold outwardly until further movement is restrained by said at least one flexible restraint connection so that engagement with a flat generally horizontal supporting surface by said lower edge of said lower portion and said lower edges of said covers supports said display device is a generally upright position.

2. The display device as defined in claim 1 wherein said lower portion includes:

a stiffened vertical region normally adjacent said spine.

3. The display device as defined in claim 2 wherein said support sheet further includes:

a cutout relief positioned between said stiffened vertical region and said spine portion.

4. The display device as defined in claim 1 wherein said upper portion includes:

an upper edge, and wherein said biasing member is connected to said upper and lower portions adjacent said upper and lower edges.

5. The display device as defined in claim 1 wherein said means to loosely connect said upper portion to said generally planar front cover include:

a headed fastener extending through said upper portion and said front cover sized to allow slight relative sliding movement between said upper portion and said front cover as said front cover and said rear cover are moved between spaced parallel and facing relationship and a planar relationship.

6. The display device as defined in claim 1 wherein said at least one flexible restraint connection includes:

a first strip extending from adjacent said front cover lower edge to adjacent said lower portion lower edge; and a second strip extending from adjacent said back cover lower edge to adjacent said lower portion lower edge, said first and second strips including a fold centrally therein facing said upper portion, whereby said first and second stripes fold between said lower portion and said front and rear covers when said covers are positioned in parallel.

7. The display device as defined in claim 1 further including:

a plurality of transparent envelopes operatively connected for leafing to said spine.

8. A display device comprising:

a protector for holding generally planar displays having:

a front cover;

a rear cover; and a spine for connecting said front and rear covers together, whereby said front cover and said rear cover can be placed generally in spaced parallel and facing relationship, a planar relationship or any position therebetween, said front and rear covers each including:

an outer surface;

an upper edge; and a lower edge; and a support sheet, said support sheet including:

an upper portion having:

a central portion adjacent said spine; and means to loosely connect said upper portion to said covers;

a lower portion having:

a lower edge;

a horizontal fold extending generally parallel to said lower edge between said upper and lower portions;

an elastic member connected between said upper and lower portions normally adjacent one of said covers; and at least one restraint connection between said lower portion and said covers, whereby said elastic member can be extended around a portion of its adjacent cover and the other cover to maintain the covers closed and when said front and rear covers are placed generally in a planar relationship cause said lower portion to fold outwardly at said horizontal fold until further movement is restrained by said at least one restraint connection so that engagement with a flat generally horizontal supporting surface by said lower edge of said lower portion and said lower edges of said covers supports said display device in a generally upright position.

9. The display device as defined in claim 8 wherein said lower portion includes:

a stiffened vertical region positioned adjacent said spine when said covers are in spaced parallel and facing relationship.

10. The display device as defined in claim 9 wherein said support sheet further includes:

a cutout relief positioned between said stiffened vertical region and said spine portion.

11. The display device as defined in claim 8 wherein said upper portion includes:

an upper edge, and wherein said elastic member is connected to said upper and lower portions adjacent said upper and lower edges.

12. The display device as defined in claim 11 wherein said elastic member is an elastic cord.

13. The display device as defined in claim 8 wherein said means to loosely connect said upper portion to said front cover include:

a fastener extending through said upper portion and said front cover sized to allow slight relative sliding movement between said upper portion and said front cover as said front cover and said rear cover are moved between spaced parallel and facing relationship and a planar relationship.

14. The display device as defined in claim 8 wherein said front and rear cover each define:

a hole therethrough, wherein said upper portion defines:

two holes therethrough, wherein said means to loosely connect said upper portion to said front cover include:

a pair of fasteners extending through said upper portion and said front cover at said holes sized with respect to the size and shape of said holes to allow slight relative sliding movement between said upper portion and said front cover as said front cover and said rear cover are moved between spaced parallel and facing relationship and a planar relationship.

15. The display device as defined in claim 8 wherein said at least one restraint connection includes:

a first strip extending from adjacent said front cover lower edge to adjacent said lower portion lower edge; and a second strip extending from adjacent said back cover lower edge to adjacent said lower portion lower edge, said first and second strips including a fold centrally therein facing said upper portion, whereby said first and second stripes fold between said lower portion and said front and rear covers when said covers are positioned in parallel.

16. The display device as defined in claim 8 further including:

a plurality of transparent envelopes operatively connected for leafing to said spine.

17. A support for a protector for holding generally planar displays that has a generally planar front cover, a generally planar rear cover; and means for connecting the front and rear covers together, whereby the front cover and the rear cover can be placed generally in spaced parallel and facing relationship, a planar relationship or any position therebetween, the generally planar front and rear covers each normally including an outer surface, an upper edge, a lower edge, connection means positioned generally vertically between said upper and lower edges; and a cover fastener hole formed therein spaced from the upper edge in each cover, wherein said support includes:

an upper portion having:

a central portion for positioning adjacent the spine; and means to loosely connect said upper portion to the covers;

a lower portion having:

a lower edge;

a horizontal fold extending generally parallel to said lower edge between said upper and lower portions;

an elastic member connected between said upper and lower portions at spaced locations;

a first restraint ribbon connected to said lower portion and including:

first connection means for attachment to the front cover; and a second restraint ribbon connected to said lower portion and including:

second connection means for attachment to the rear cover.

18. The support as defined in claim 17 wherein said lower portion includes:

a central stiffened vertical region.

19. The support as defined in claim 18 wherein said central stiffened vertical region includes:

a cutout relief positioned at said horizontal fold.

20. The support as defined in claim 17 wherein said means to loosely connect said upper portion to the covers include:

elongate holes therethrough.

* * * * *